US010384118B1

(12) United States Patent
Osterman

(10) Patent No.: US 10,384,118 B1
(45) Date of Patent: Aug. 20, 2019

(54) SYSTEM AND METHOD FOR MONITORED RAFFLE CONTESTS

(71) Applicant: Daniel Osterman, San Juan, PR (US)

(72) Inventor: Daniel Osterman, San Juan, PR (US)

( * ) Notice: Subject to any disclaimer, the term of this patent is extended or adjusted under 35 U.S.C. 154(b) by 0 days.

(21) Appl. No.: 16/018,990

(22) Filed: Jun. 26, 2018

(51) Int. Cl.

| | |
|---|---|
| ***A63F 9/24*** | (2006.01) |
| ***A63F 3/06*** | (2006.01) |
| ***A63F 3/08*** | (2006.01) |
| ***G07F 17/32*** | (2006.01) |

(52) U.S. Cl.
CPC ..... *A63F 3/0655* (2013.01); *A63F 3/0605* (2013.01); *A63F 3/08* (2013.01); *G07F 17/329* (2013.01); *G07F 17/3223* (2013.01); *G07F 17/3241* (2013.01)

(58) Field of Classification Search
CPC .... A63F 3/00; A63F 3/08; A63F 3/081; A63F 3/065; A63F 3/0655; G07F 17/32; G07F 17/329; G07F 17/3258; G07F 17/3244; G07F 17/42
See application file for complete search history.

(56) References Cited

U.S. PATENT DOCUMENTS 5,755,369 A * 5/1998 Holmes ..... B26F 3/002 206/214
7,090,578 B2 * 8/2006 Anderson ..... A63F 3/081 273/139
8,038,519 B1 * 10/2011 Luciano, Jr. ..... G07F 17/326 463/16
2001/0037239 A1 * 11/2001 Kanatani ..... G06Q 30/02 705/14.15
2004/0254008 A1 * 12/2004 Anderson ..... A63F 3/081 463/17
2005/0187021 A1 * 8/2005 Daskalakis ..... G06Q 30/0212 463/42
2007/0117637 A1 * 5/2007 Morgan ..... A63F 13/12 463/43
2015/0310697 A1 * 10/2015 O'Hagan ..... G07F 17/329 463/17

FOREIGN PATENT DOCUMENTS

GB 2193441 A * 2/1988 ..... A63F 3/081
WO WO-2004099915 A2 * 11/2004 ..... A63F 3/081

* cited by examiner

*Primary Examiner* — Milap Shah
(74) *Attorney, Agent, or Firm* — Eugenio J. Torres-Oyola; Victor M. Rodriguez-Reyes; Rafael Rodriguez-Muriel

(57) ABSTRACT

A raffle contest system that comprises a database, wherein tickets are sold electronically and information about every ticket is stored in said database. Said container is surveilled at all times by a camera, wherein the video-stream provided by the camera is accessible by users at all times and shows every ticket being printed and dropped into the container immediately after purchase. Purchased tickets comprise identification information to ensure authenticity and integrity of the process. Customers can verify the status of the container, their purchased tickets and interact with other customers at all times during the raffle process. Drawings of the winning tickets are also broadcast through the same video-stream to ensure that the container was not tampered with at any time.

13 Claims, 2 Drawing Sheets

SYSTEM AND METHOD FOR MONITORED RAFFLE CONTESTS

STATEMENT REGARDING FEDERALLY SPONSORED RESEARCH AND DEVELOPMENT

N/A

RELATED APPLICATIONS

N/A

BACKGROUND OF INVENTION

Field of the Invention

The present disclosure relates generally to raffle contests, more specifically, to a system and a method for carrying out raffle contests that can be monitored by contestants at all times, giving more reliability and trustworthiness to the process and making the contest more attractive to customers and more profitable to organizers.

Background of the Invention

Raffle contests have been very popular for a long time. People are drawn to raffles because, as opposed to a lottery, a winner is always guaranteed. However, raffle contestants always depend on the good faith of the organizers to properly carry out the raffle and select the winners.

Many elements of a raffle contest are carried out behind the scenes, and therefore hidden to contestants. Contestants do not know when or how the purchased tickets are being handled and if the contests is being carried out as advertised. This makes the trustworthiness of the process decline and participation less attractive to people. For example, when a person buys a ticket to participate in a raffle, he or she is told that the purchased ticket will be placed in a group with all the other purchased tickets. The customer has no guarantee that this will actually happen, and simply has to trust the seller.

Furthermore, raffle tickets are sold from various locations, making the process of grouping all the purchased tickets susceptible to tampering or accidents. When the process is full of uncertainty and so reliant on good faith, customers are more reluctant to spend their money on participating in such a contest.

Therefore, there is a need for an improved system and method for raffle contests with high level of reliability and trustworthiness to entice customers, increase profit, and provide better prizes. More specifically, there is a need for a monitored system and method for raffle contests where customers are able to witness every step of the process, from the moments the ticket is purchased, to the moment the winning tickets are drawn.

SUMMARY OF THE INVENTION

All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications are referred to herein, this reference does not constitute an admission that any of these documents form part of the common general knowledge in the art.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

A primary object of the present disclosure is to provide a system for carrying out raffle contests where the participating customers can monitor the process from start to finish, on demand. The system comprises a printer and a container wherein every time a raffle ticket is purchased it will be printed and dropped inside the container, wherein said raffle ticket contains identification information about the customer. The system further comprises a camera and a database, wherein said camera provides a surveillance video-stream of the container at all times and said database contains information about every purchased ticket, wherein said video-stream and database information can be accessible from any device connected to the Internet or from a raffle ticket kiosk.

Another object of the present invention is to provide a system for raffle contests where participating customers can interact with each other to drive more ticket sales and increase prices. The present system comprises a database of user accounts for every customer that purchases a raffle ticket. Said user accounts contain information about the customer and every purchased ticket. The system further comprises a communication module so users participating in the same raffle can interact with each other. The system of the invention itself, both as to its configuration and its mode of operation will be best understood, and additional objects and advantages thereof will become apparent, by the following detailed description of a preferred embodiment taken in conjunction with the accompanying drawing.

When the word "invention" is used in this specification, the word "invention" includes "inventions", that is, the plural of "invention". By stating "invention", the Applicant does not in any way admit that the present application does not include more the one patentable and non-obviously distinct invention and Applicant maintains that the present application may include more than one patentably and non-obviously distinct invention. The Applicant hereby asserts, that the disclosure of the present application may include more than one invention, and, in the event that there is more than one invention, that these inventions may be patentable and non-obvious one with respect to the other.

Further, the purpose of the accompanying abstract is to enable the U.S. Patent and Trademark Office and the public generally, and especially the scientists, engineers, and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

DESCRIPTION OF EXAMPLE EMBODIMENTS

Figure 1:
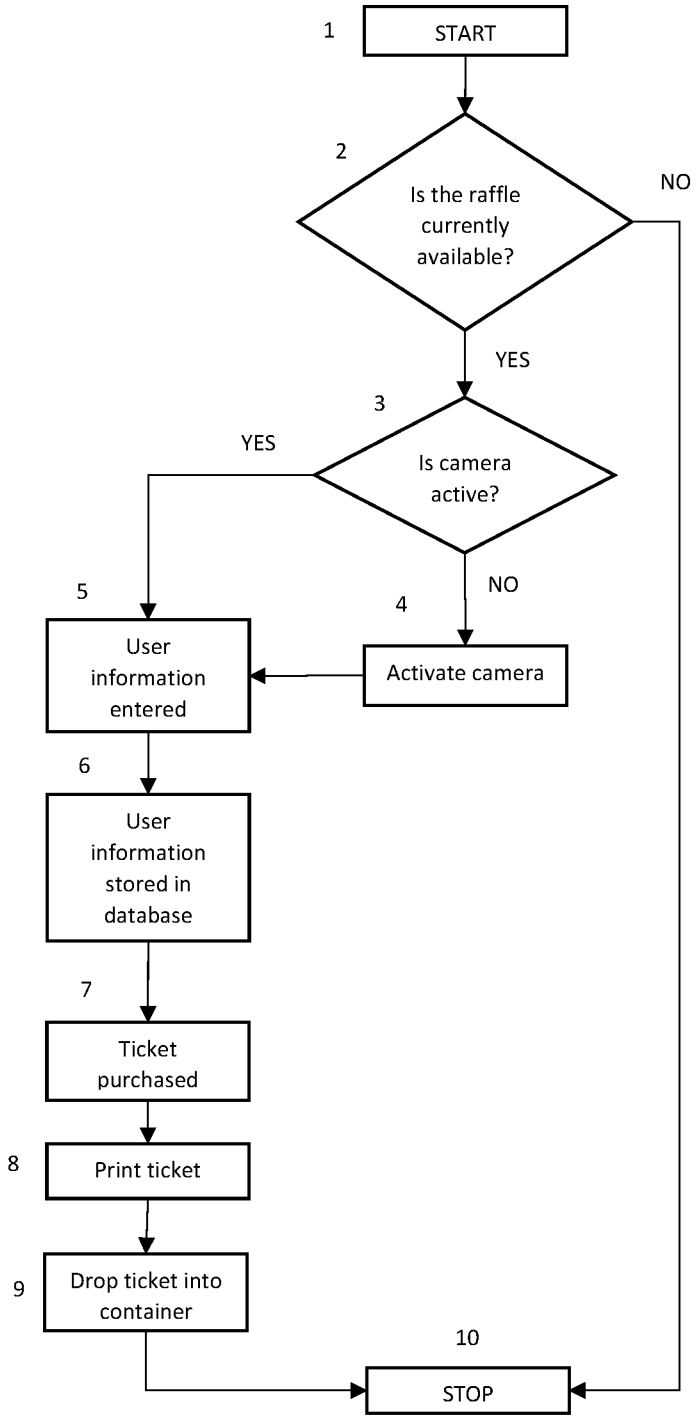
FIG. 1 is a flowchart of an example process according to an embodiment of the present invention.

To provide an overall understanding of the invention, certain illustrative embodiments and examples will now be described. However, it will be understood by one of ordinary skill in the art that the same or equivalent functions and sequences may be accomplished by different embodiments that are also intended to be encompassed within the spirit and scope of the disclosure. The compositions, apparatuses, systems and/or methods described herein may be adapted and modified as is appropriate for the application being addressed and that those described herein may be employed in other suitable applications, and that such other additions and modifications will not depart from the scope hereof.

As used in the specification and claims, the singular forms "a", "an" and "the" include plural references unless the context clearly dictates otherwise. For example, the term "a transaction" may include a plurality of transaction unless the context clearly dictates otherwise. As used in the specification and claims, singular names or types referenced include variations within the family of said name unless the context clearly dictates otherwise.

Certain terminology is used in the following description for convenience only and is not limiting.

The present disclosure is related to a raffle system. An exemplary embodiment of the present invention comprises a database wherein information about each ticket and customer is stored. Every raffle ticket comprises unique identification elements, including but not limited to alphanumerical codes, barcodes, Quick Response codes, ultraviolet ink, user pictures, or holographic security stickers. These security elements allow for verification of the authenticity and tracking of the ticket at any moment by matching the information in the security element with the information stored in the database. Every ticket purchase requires the customer to enter identification information such as name, email, address, phone number, or any means of contacting and authenticating the identity of the purchaser of the ticket. This information will be incorporated into the ticket receipt provided to the participating customer and stored in the database so it can be cross-checked at any time, assuring the customer that their ticket is in the running for a prize and the organizers that the ticket purchaser is the person claiming the prize. Every customer can access their account using a device connected to the Internet. When accessing their account, the customer can see a list of all the purchased tickets and the dates for every raffle contest drawing.

When a user buys a raffle ticket, the ticket is instantly printed and dropped into a container with all the participating tickets of the same raffle contest. This process can be witnessed by the customer, as the container is surveilled at all times by a camera which provides an on-demand video-stream. Raffle tickets can be purchased from an Internet-connected device or from tickets kiosks. The purchasing portal from where tickets can be purchased online has a link to access the video stream of the container related to every raffle contest. The ticket kiosks allow customers to purchase raffle tickets and have a display where the video-stream of the container can be watched instantly after purchase of a raffle ticket is complete.

As shown in FIG. 1, the process starts from a user accessing the ticket purchase website, application or kiosk (step 1) to verify if a raffle contest is currently available (step 2). If there is no contest available, the user cannot proceed. If there is a contest available, the user will select it and the system will proceed to verify if the camera is active (step 3). If the camera is not active, because no tickets have been sold for that specific, the system will proceed to activate the camera (step 4). After the camera is active and the user can see the activity in the container, the user can proceed to enter information to purchase a ticket (step 5). The entered information will be stored in a database for later authentication (step 6). When all the information has been processed, the ticket purchase is final (step 7). The ticket information will be sent to the printer so it can be printed directly into the container, as the user watches (steps 9 and 10). The process is then finalized until another ticket is purchased (step 10).

Figure 2:
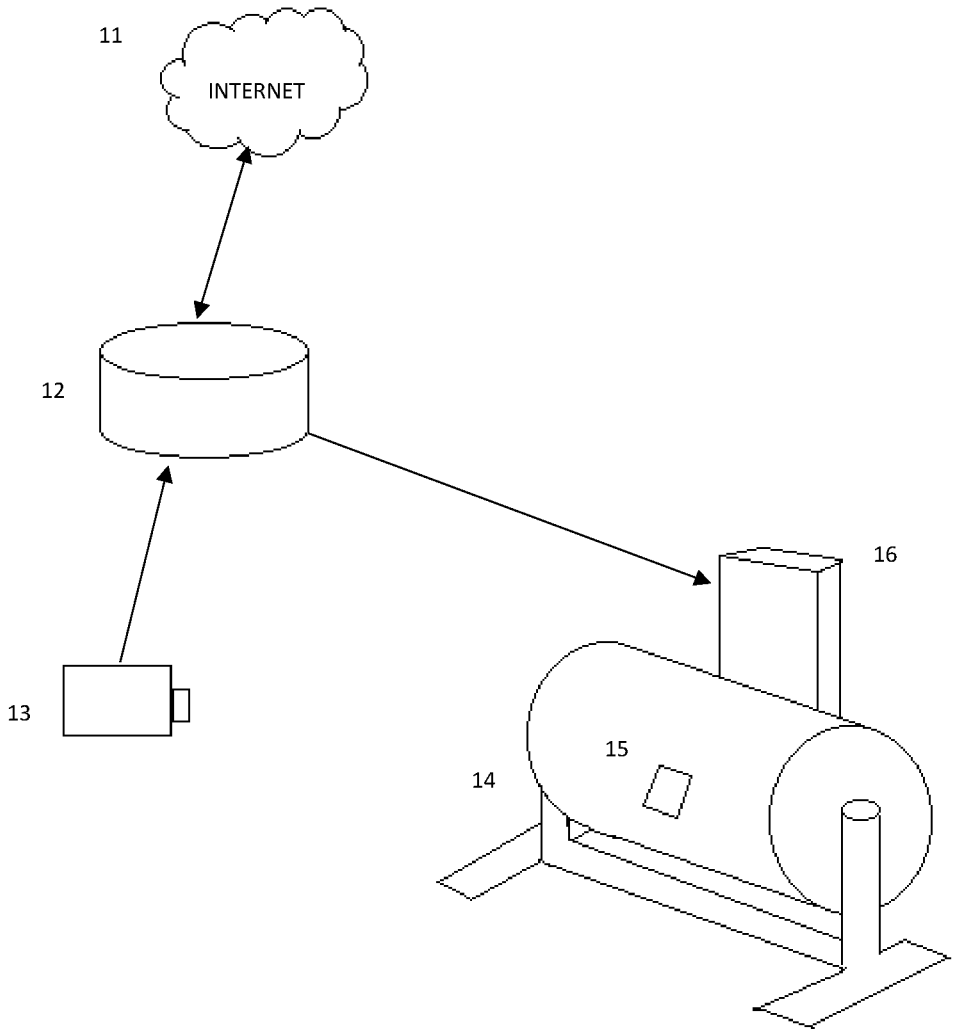
FIG. 2 illustrates a raffle system according to the present disclosure.

FIG. 2 illustrates an exemplary embodiment. A server 12, which is connected to the Internet 11 is configured to send and receive data. Said server 12 can receive ticket information after a ticket is purchased. Said ticket information is transmitted to a ticket printer 16, which is attached to a container 14 where all the purchased tickets are being grouped for selecting a winner when the contest ends. The server is further connected to a camera 13, which is pointing at the container 14 and provides video of the activity in the container. The video provided by the camera 13 is transmitted to the server 12, which broadcasts it over the Internet 11 for users to watch and rest assured that their ticket is running in the contest. The container 14 comprises an opening 15, so the winning ticket can be selected when the contest ends.

Another exemplary embodiment of the present invention comprises a communication platform wherein participating customers of the same raffle contest can interact with each other. Since raffle contest prizes increase as more tickets are sold, customers can gauge if they should buy more tickets to unlock more prizes based on customer activity. For example, a current raffle contest prize is a car, but if 1,000 more ticket are sold, the prize will include $10,000 in addition to the car, or as a secondary prize. Knowing how many tickets are needed to be sold to achieve the additional 1,000 and how many customers are interested in the prizes helps customers determine if it is worth spending more money on the contest or not. The communication platform also provides reminders to users about the contest ending, so they do not miss the cut-off date for participating.

Raffle contest drawings are broadcast on the same video-stream as the containers. When ticket sales end for a specific raffle contest, a person will draw the winning ticket or tickets from the container while every step of the process is captured by a camera as it happens. Customers are able to see that the same container where their ticket was dropped into after purchase is the one from where the winning ticket is drawn. There is no doubt as to whether any ticket was lost during the process, or if the organizers tampered with its integrity.

The invention is not limited to the precise configuration described above. While the invention has been described as having a preferred design, it is understood that many changes, modifications, variations and other uses and applications of the subject invention will, however, become apparent to those skilled in the art without materially departing from the novel teachings and advantages of this invention after considering this specification together with the accompanying drawings. Accordingly, all such changes, modifications, variations and other uses and applications which do not depart from the spirit and scope of the invention are deemed to be covered by this invention as defined in the following claims and their legal equivalents. In the claims, means-plus-function clauses, if any, are intended to cover the structures described herein as performing the recited function and not only structural equivalents but also equivalent structures.

All of the patents, patent applications, and publications recited herein, and in the Declaration attached hereto, if any, are hereby incorporated by reference as if set forth in their entirety herein. All, or substantially all, the components disclosed in such patents may be used in the embodiments of the present invention, as well as equivalents thereof. The details in the patents, patent applications, and publications incorporated by reference herein may be considered to be incorporable at applicant's option, into the claims during prosecution as further limitations in the claims to patentable distinguish any amended claims from any applied prior art.

What is claimed:

1. A system for carrying out raffle contests comprising:

a server;

a physical container having at least one opening;

at least one camera; and a ticket printer;

wherein said at least one camera is pointing at said physical container;

wherein said ticket printer is physically attached to said physical container;

wherein tickets are printed by said ticket printer and are directly dropped into said physical container through the opening in the physical container without human intervention;

wherein said at least one camera is operatively connected, via a communication platform, to said server;

wherein said ticket printer is operatively connected, via said communication platform, to said server;

wherein said server is configured to provide an on-demand video stream of activity within said physical container, the activity captured by the at least one camera pointing at said physical container, the on-demand video stream transmitted over said communication platform to a computing device;

wherein said server is configured to receive data indicative of ticket information; and wherein said server is configured to send data indicative of the ticket information to said ticket printer.

2. The system of claim 1, further comprising a database, wherein said database comprises said ticket information and user information.

3. The system of claim 2, wherein said ticket information is one or more of ticket number, ticket purchase date, and ticket price.

4. The system of claim 2, wherein said user information is one or more of phone number, address, and email address.

5. The system of claim 1, wherein said tickets printed by the ticket printer comprise verification information.

6. The system of claim 5, wherein said verification information is one or more of alphanumerical codes, barcodes, Quick Response codes, ultraviolet ink, user pictures, or holographic security stickers.

7. A method for carrying out raffle contests comprising the steps of:

receiving, over a communication platform, purchased ticket information by a server;

transmitting, over said communication platform, said purchased ticket information by the server to a ticket printer, wherein the ticket printer is physically attached to a physical container, and wherein the physical container has at least one opening;

printing, by the ticket printer, a ticket with said ticket information;

dropping, by the ticket printer, the printed ticket directly into the physical container through the opening in the physical container without human intervention; and providing an on-demand video stream, transmitted by the server over the communication platform to a computing device, of activity occurring within the physical container, the activity captured by at least one camera pointed at said physical container.

8. The method of claim 7, further comprising storing said purchased ticket information in a database.

9. The method of claim 7, wherein said purchased ticket information is one or more of ticket number, ticket purchase date, and ticket price.

10. The method of claim 7, further comprising storing user information in a database.

11. The method of claim 10, wherein said user information is one or more of phone number, address, and email address.

12. The method of claim 7, wherein said ticket printed by the ticket printer comprises verification information.

13. The method of claim 12, wherein said verification information is one or more of alphanumerical codes, barcodes, Quick Response codes, ultraviolet ink, user pictures, or holographic security stickers.

* * * * *